US007596966B2

(12) United States Patent
Garvin

(10) Patent No.: US 7,596,966 B2
(45) Date of Patent: Oct. 6, 2009

(54) INTERCHANGEABLE JEWELRY CLIP

(76) Inventor: Timothy Vincent Garvin, 2409 Perkins Rd., Durham, NC (US) 27705

( * ) Notice: Subject to any disclaimer, the term of this patent is extended or adjusted under 35 U.S.C. 154(b) by 479 days.

(21) Appl. No.: 11/228,044

(22) Filed: Sep. 15, 2005

(65) Prior Publication Data

US 2007/0089455 A1 Apr. 26, 2007

(51) Int. Cl.
*A44C 13/00* (2006.01)
*A44C 25/00* (2006.01)

(52) U.S. Cl. ..... 63/1.16; 63/1.18; 63/40

(58) Field of Classification Search ..... 63/1.1, 63/1.16, 1.17, 1.18, 18, 19, 21, 24, 25, 33, 63/41, 29.1, 30; 24/67 R, 67.9, 545, 3.1, 24/3.12, 113 R, 113 MP; 40/652, 658, 666, 40/673; 206/0.18, 38
See application file for complete search history.

(56) References Cited

U.S. PATENT DOCUMENTS

| | | | | | |
|---|---|---|---|---|---|
| 213,306 | A | * | 3/1879 | Stieglitz | 40/652 |
| 345,934 | A | * | 7/1886 | Thal | 24/56 |
| D24,073 | S | * | 2/1895 | Smith | D19/65 |
| 1,103,031 | A | * | 7/1914 | Carter | 40/658 |
| 1,223,630 | A | * | 4/1917 | Smeeton | 24/563 |
| 1,504,141 | A | * | 8/1924 | Rlitter | 40/658 |
| 2,358,262 | A | * | 9/1944 | Suess | 63/18 |
| 2,550,828 | A | * | 5/1951 | Lawson, Jr. et al. | 63/14.3 |
| 2,595,672 | A | * | 5/1952 | Greenwood | 381/322 |
| 2,640,238 | A | | 6/1953 | Schur | |
| 2,867,925 | A | * | 1/1959 | Botts | 40/658 |
| 3,343,230 | A | * | 9/1967 | Darvie | 24/113 R |
| 3,543,354 | A | * | 12/1970 | Mitchell, Jr. et al. | 24/102 PL |
| 3,670,524 | A | * | 6/1972 | Korwin | 63/18 |
| 3,739,598 | A | | 6/1973 | Postel | |
| 4,343,104 | A | * | 8/1982 | Szabo | 40/661.06 |
| 4,706,342 | A | * | 11/1987 | Yu | 24/67.9 |
| 4,793,155 | A | | 12/1988 | Law | |
| 4,899,556 | A | | 2/1990 | Ford | |
| 5,188,679 | A | | 2/1993 | Kretchmer | |
| 5,339,655 | A | | 8/1994 | Grando | |
| 5,685,174 | A | | 11/1997 | Balzer | |
| 5,806,346 | A | | 9/1998 | Schlinger | |
| 6,427,487 | B1 | | 8/2002 | Morgan | |
| 6,484,537 | B2 | | 11/2002 | Takessian | |
| 6,715,315 | B1 | | 4/2004 | Hartgrove | |
| 6,973,700 | B2 | * | 12/2005 | Hsiao | 24/67.9 |
| 7,389,567 | B2 | * | 6/2008 | Rogers et al. | 24/113 R |

* cited by examiner

*Primary Examiner*—Robert J Sandy
*Assistant Examiner*—Ruth C Rodriguez
(74) *Attorney, Agent, or Firm*—Borton Petrini, LLP; Jeffrey A. Travis

(57) ABSTRACT

A jewelry device for displaying decorative ornamentation comprising a single spring tension member made of any lightweight metal or plastic frame and folded to form a spring tension clip. The clip is capable of securing an ornament. One end of the clip may be an enlarged first end with an aperture capable of showing an ornament by allowing it to protrude through the aperture from the back and through the front of the enlarged first end, where the ornament has a backing portion preventing it from falling through the aperture. The ornament and backing portion are secured between the first and second ends through the spring tension of the clip formed from the folding of the frame. Further, the clip may incorporate earring posts, holes, pin, or cuff links, or other attachment mechanisms for creating various types of jewelry using the present invention.

2 Claims, 5 Drawing Sheets

Earrings

Pendants

Pins

Bracelet

INTERCHANGEABLE JEWELRY CLIP

BACKGROUND OF THE INVENTION

1. Field of the Invention

The present invention relates to a jewelry device. More particularly, the present invention relates to an interchangeable jewelry device wherein various ornaments can be easily secured and removed by hand through the use of a spring tension clip and made available on pendants, necklaces, pins, bracelets, or other types of jewelry.

2. Description of Related Prior Art

There are innumerable methods of making and displaying jewelry on the human body. There are also innumerable methods and mediums which artists have used to create these jewelry items. As an example, pendants, decorative ornaments hung from a cord or chain around the neck, have been part of every human culture for millennia. The same is true for earrings, bracelets, pins, and other types of necklaces.

Typically, a casing (usually a decorative metal) is fashioned to hold some kind of ornament or gemstone within its confines. The ornament or stone is then permanently set within the casing by soldering or is secured by other well known techniques in the art (e.g., rivets, adhesives, folded tabs or prongs) One variation on how an ornament can be set is found in U.S. Pat. No. 3,670,524 to Korwin wherein an ornament is secured through the use of folded tabs around the casing. In such a fastening, the ornament is permanently secured within the setting.

A limitation with all of the techniques thus described and others not mentioned here is their structural permanency. Once secured onto the casing the ornaments are incapable of being removed without destroying the ornament or the casing itself. If repairs or a replacement is needed, it must be done by a professional jeweler, customarily at the expense of the owner.

How can this structural permanency limitation of most jewelry be addressed in a simple, efficient and cost-effective way? The present invention provides the answer by allowing jewelry wearers the ability to instantly change the design of an item of jewelry to accessorize with different clothing, makeup, or hair colors.

Previous attempts have been made to create interchangeable jewelry constructions. Each, however, is limited by the need for excessive and elaborate construction and machining, bringing to mind the adage, "more is less and less is more.

For example, U.S. Pat. No. 4,793,155 issued to Law for "Jewelry with Interchangeable Ornamentation," provides a method for interchangeability requiring numerous and separate "fingers" which protrude from the circumference of the backing or casing and also requires a separate element for securing to the person. In this design, there are many component parts that need to be arranged to form the whole—a construction which is costly, inelegant, and excessive for the purpose of interchangeability.

There is one method in the relevant art for setting an ornament through compression spring force found in U.S. Pat. No. 5,188,679 to Kretchmer. However, like other devices and methods for setting jewelry items, this method teaches how to permanently secure a gemstone through a special annealing and heat treatment of a gemstone to secure it to the metal alloy so that "[w]hen struck with unusual force" the gemstone will not be dislodged from its setting. This method is also time-consuming and costly since it requires special techniques to be used to cast and then treat alloy to get it to a hardened state. Lastly, the method does not allow for other, more inexpensive materials to be used such as plastic or the kinds of lightweight metals desirable to create the present invention.

These patents, and others like them, referenced in documentation attached to this application, cover a variety of devices and methods for holding or setting stones, gems, or other decorative pieces in a variety of frames and settings, and all require either detailed machining or the creation of complicated parts and devices. Further, they all require a permanency in settings and do not provide interchangeability as in the present invention.

What is needed is a jewelry device providing beautiful, interchangeable ornamentation but requiring fewer parts and less expensive methods of manufacture and design. In short, a design for interchangeability that is elegant in the simplicity of its construction while still retaining the beauty of its design.

SUMMARY OF THE INVENTION

Accordingly, one object of the present invention is to provide a jewelry device for displaying decorative ornamentation comprising a spring-tension member capable of removably securing an ornament.

Another object of the present invention is to provide a jewelry device wherein the spring tension member further comprises a folded frame.

Another object of the present invention is to provide a jewelry device wherein the spring tension member further comprises a folded metal frame with a first and second end; the first and second end are oppositely positioned from each other; and the first end having means for displaying an ornament.

Another object of the present invention is to provide a jewelry device wherein the spring tension member further comprises a folded metal frame with a first and second end; the first and second end are oppositely positioned from each other; the first end is enlarged with an aperture; the ornament comprises means for securing to a backing portion; the backing portion is a size larger than the aperture but smaller than the enlarged first end; the ornament and backing portion are removeably secured through spring tension between the enlarged first end and the second end; and the jewelry device further comprises means for removably securing to a person.

Another object of the present invention is to provide a jewelry device for displaying decorative ornamentation comprising a spring tension member with a first and second end; the first and second ends are oppositely positioned from each other; the first end is enlarged with an aperture and further comprises a front and a back; the ornament is capable of protruding through the aperture from the back through the front and further having means for securing to a backing portion; the backing portion is larger than the aperture but smaller than the enlarged first end; the ornament and backing portion are removably secured through spring tension between the enlarged first end and the second end; the spring tension member has means for removably securing to a person; and the spring tension member comprises decorative means.

Another object of the present invention is to provide a jewelry device wherein the means for removably securing to a person comprises an earring post coupled to the spring tension member or to the frame.

Another object of the present invention is to provide a jewelry device wherein the means for removably securing to a person comprises a pin type jewelry finding.

Another object of the present invention is to provide a jewelry device wherein said means for securing to a person comprises a bracelet.

Another object of the present invention is to provide a method for creating a jewelry device for interchangeable decorative ornamentation by cutting a spring tension member into a desired shape with a first and second end; and folding the spring tension member such that it forms a clip capable of removably securing an ornament between the first and second ends.

Another object of the present invention is to provide a method for creating a jewelry device for displaying decorative ornamentation wherein the process further comprises selecting a lightweight frame metal as the spring tension material; creating an aperture in the first end of the frame metal; creating the ornament with means for preventing it from sliding out of the aperture; positioning the ornaments such that the ornament fits into the aperture; and incorporating decorative means on the spring tension member or frame.

Another object of the present invention is to provide a method for creating a jewelry device for displaying decorative ornamentation wherein the means for preventing the ornament from sliding out of the aperture comprises creating the ornament with a non-decorative side; creating a backing portion with means for securing it to the non-decorative side of the ornament; and positioning the ornaments such that when the ornament fits into the aperture the backing portion prevents the ornament from sliding through the aperture.

Another object of the present invention is to provide a method for creating a jewelry device for displaying decorative ornamentation wherein the spring tension material comprises plastic.

Another object of the present invention is to provide a method for creating a jewelry device for displaying decorative ornamentation wherein the means for securing to a person is a necklace strand.

Another object of the present invention is to provide a method for creating a jewelry device for displaying decorative ornamentation wherein the means for securing to a person is a bracelet.

Another object of the present invention is to provide a method for creating a jewelry device for displaying decorative ornamentation wherein the means for securing to a person is a necklace strand wherein the means for securing to a person is an earring.

Another object of the present invention is to provide a method for creating a jewelry device for displaying decorative ornamentation wherein the means for securing to a person is a pin.

DETAILED DESCRIPTION OF THE DRAWINGS AND PREFERRED EMBODIMENTS

A complete understanding of this invention can be gained through reference to the drawings in conjunction with a thorough review of the disclosure herein.

Figure 1:
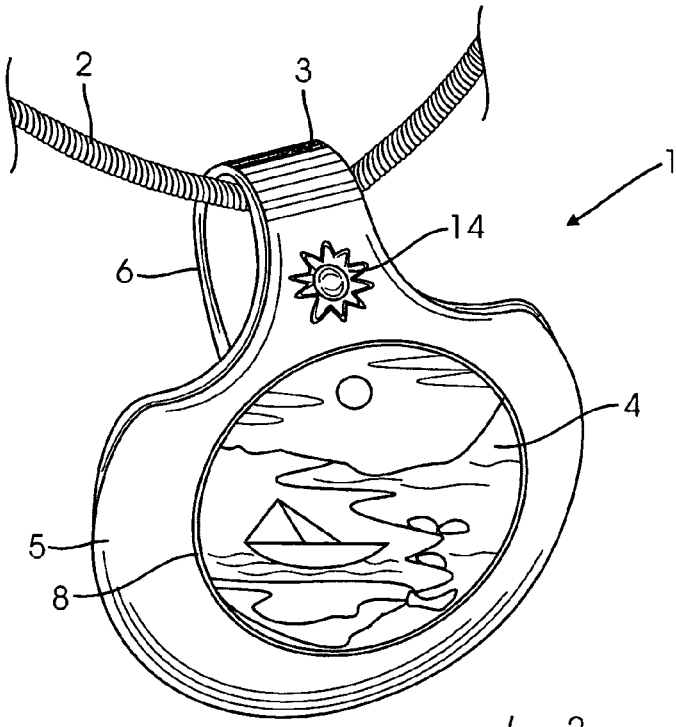
FIG. 1 is a front perspective view of the present invention showing one embodiment of the ornamentation being secured by a spring clip.

FIG. 1 shows a general view of an exemplary embodiment of the present invention in the form of a pendant 1. The pendant is made from a single frame 5 that is bent and shaped to display an ornament 4 and secure it by means of spring tension by a clip 6 created as a result of the bending of the frame. The pendant is secured to a person by a necklace strand 2 that passes through the fold 3 in the pendant. It should be understood that the embodiment is one of many that can incorporate this design. However, for purposes of explanation of the utility of this invention, the pendant will be the primary embodiment used to describe its novelty.

Figure 2:
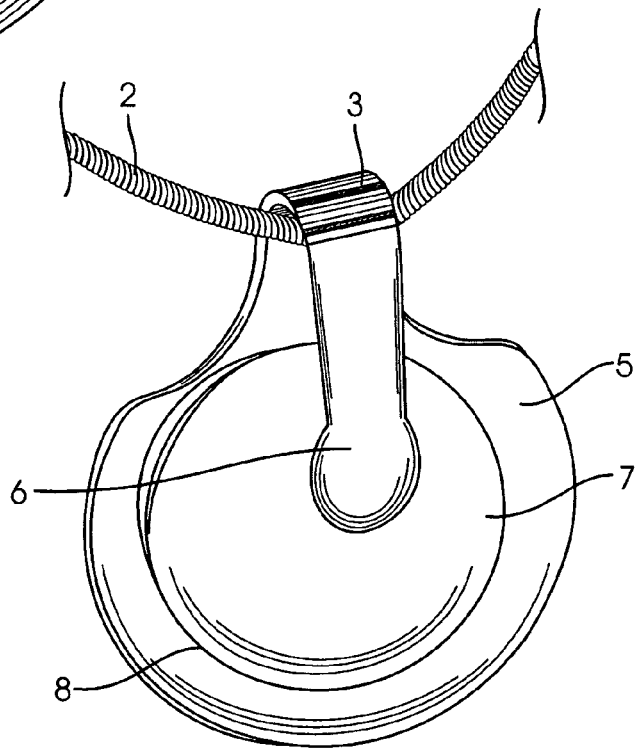
FIG. 2 is a rear view of the present invention showing a clip securing an ornament.

Critical to the success of the present invention is the spring tension clip 6. FIG. 2 shows a rear view of the pendant whereby a single frame 5 is folded 3 to form a spring tension clip 6. The ornament 4 is secured to the pendant by the tension of the clip pressing against a backing member 7, which is affixed to the back of the ornament. To place the ornament into the hole or aperture 8 of the frame, the clip is bent slightly to allow for the insertion of the ornament and backing portion. Once inserted, the clip is then bent back (e.g., with fingers) and pressed against the backing portion thereby securing the ornament in its place in the aperture.

Figure 3:
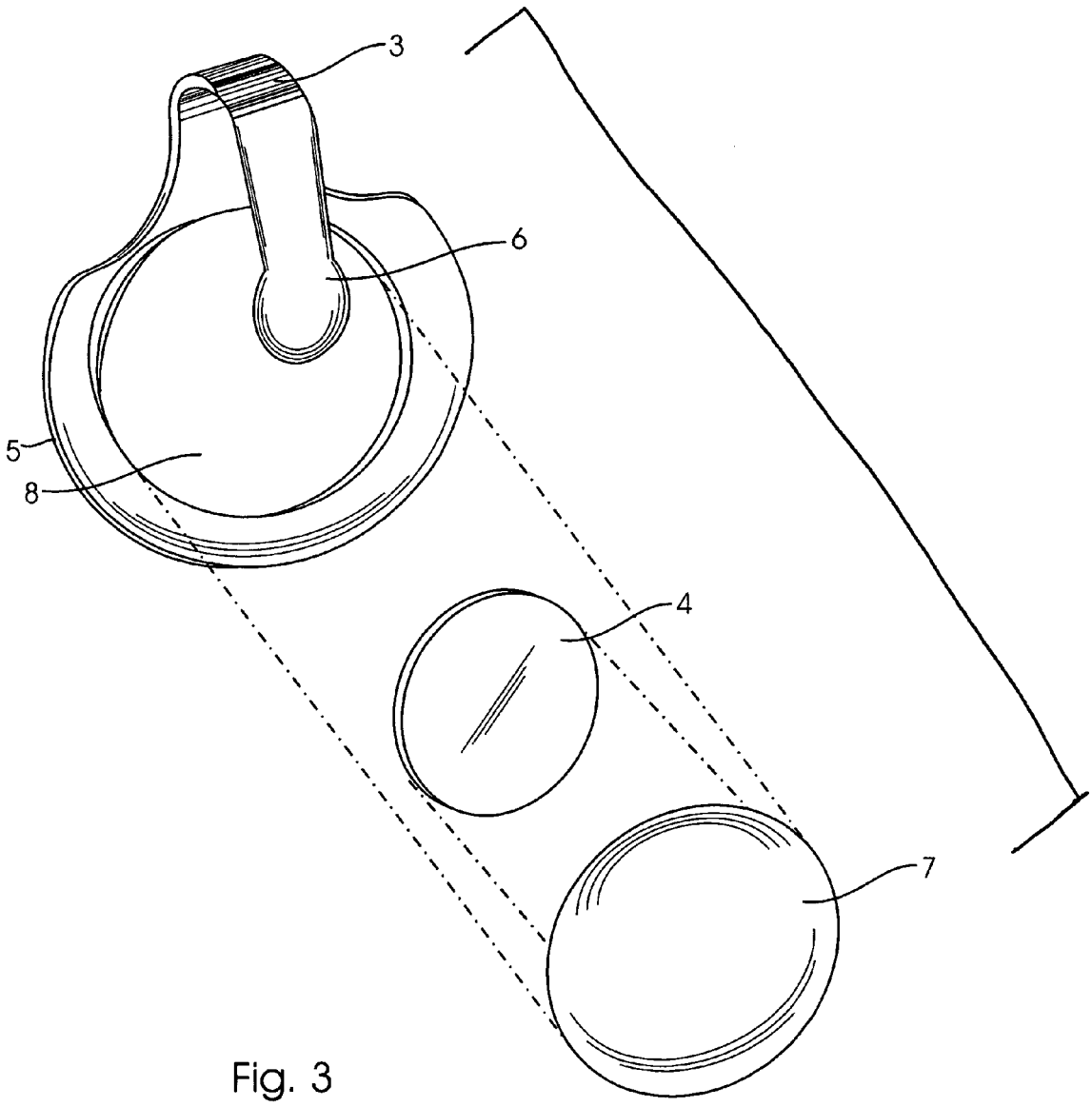
FIG. 3 is an exploded view showing the relationship of the parts of the present invention incorporated as a pendant.

To achieve the primary purpose of the present invention, a single frame 5 is bent either from the top, bottom, or side of the piece around to the back, where it holds by spring tension, an ornament. In an exemplary embodiment, the frame is composed of a lightweight, flexible metal such as silver, copper, gold, brass, bronze, or other lightweight steel which have proven to achieve the necessary spring tension. In this way, once the frame is folded and the spring tension is achieved, the spring can be easily moved by hand so as to insert and reinsert a different ornament 4 into the aperture or hole 8 formed in the frame 5. The exploded view of FIG. 3 shows the relationship of the frame, ornament, and backing elements with the hole as they exist when broken out separately. It should also be noted that in FIG. 3, the ornament 4 in a preferred embodiment, fits flush into the hole 8 and the backing portion is slightly larger than the frame 5 even though it may not visually appear to be so in this figure.

In addition to metal, plastic can also be used to form the requisite spring tension clip. However, this is not a preferred embodiment since, although it achieves some of the objects of the present invention, it is not as desirable as a jewelry object.

The ornament 4 that is displayed on the pendant is created from processes and materials well known in the art to create a design on the ornament. An exemplary embodiment of the present invention is to create a rounded ornament from porcelain clay using the millefiori technique. (As began in the Alexandrian and Roman ages, the millefiori technique consists of slicing cross-sections from colored glass or clay rods, which sections are then used as ornament. Millefiori sections in glass-making are traditionally fused into clear glass to make paperweights, pillboxes or jewelry such as necklaces and pendants. It is used in porcelain clay and the modern polymer clay to create jewelry, plaques, and vessels of various kinds.) It will be readily ascertained by artists in this field that many decorative elements such as stone, plastic, glass, gems, or other materials could be used as an ornament as can many other techniques combined with these elements to create a desirable ornamental effect.

A look at FIGS. 1 and 3 also show a preferred embodiment of the ornament 4 as it is separated from the spring tension clip 6 of the pendant. In these Figures, the ornament is rounded, painted porcelain or other decorative material or gem that protrudes from the pendant opening 8 when it is secured in the pendant by the spring clip 6. However, it will be readily understood by those in the art that the ornament can be of any shape, design, or material. Similarly, the aperture or hole 8 in the pendant frame into which the ornament fits, can be configured in any shape suitable to accept the ornamental shape.

In the embodiment shown in FIG. 1, an aperture or hole 8 is formed in one part of the frame 5 so that it can hold an ornament 4 inserted from the back and which protrudes through and is visible from the front of the pendant. Also on the frame 5 of the pendant, any type of decorations are possible including but not limited to etching, engraving, painting, carving, ornamentation glued to the pendant or in other ways fixed to the frame, and many more creative mechanisms commonly used in the art to decorate jewelry items. Currently, small engravings 14, oftentimes thematically linked to the ornament, are etched or engraved onto the metal frame by the inventor to further decorate the pendant.

Figure 8:
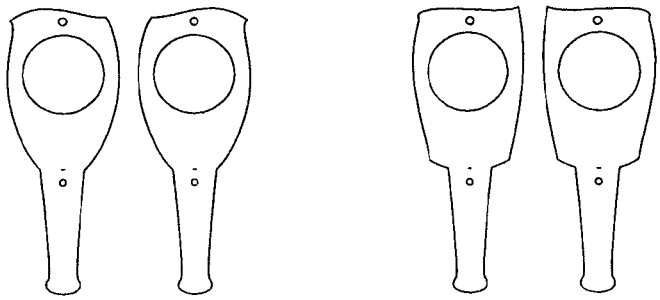
FIG. 8 depicts several frame shapes before being folded into a clip.
Figure 8:
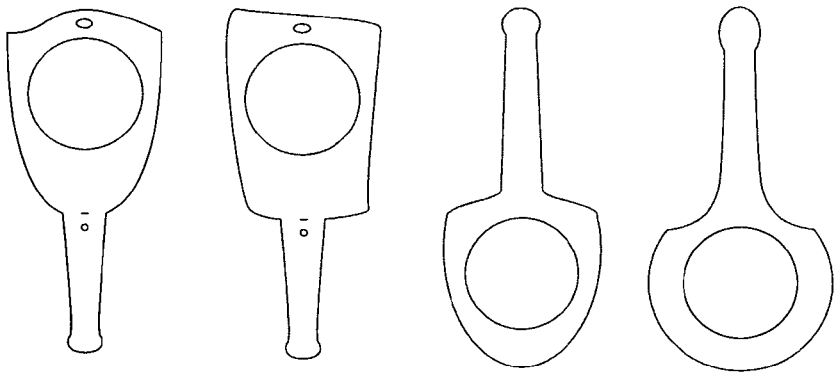
Figure 8:
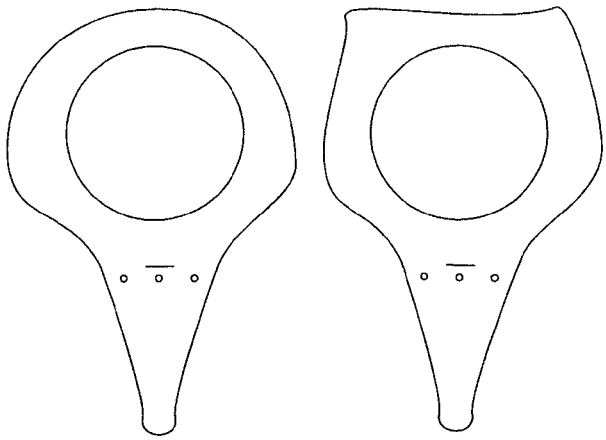
Figure 8:
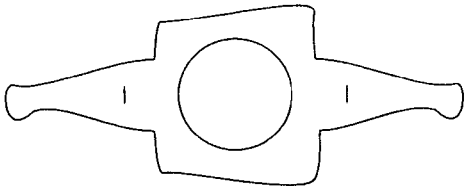

Additionally, the hole 8 and the shape of the frame 5 can be created to form any shape desired and is not limited to the embodiments illustrated by the figures shown in this application. FIG. 8 shows several different possible frame designs after cutting and shaping but before folding. To achieve the desired shape of the frame a carefully drawn pattern or model is sent to a metalworker who can etch, cut, or stamp metal plates according to the specifications set out by the designer.

In the embodiment shown in FIGS. 1 through 3 an ornament 4 is secured in place by a backing portion 7, which prevents the ornament from slipping through the hole 8 in the frame 5 and also serves as a contact point for the clip 6 so that neither the ornament 4 or spring clip is abraded by the insertion and reinsertion of the ornament. The backing, in a preferred embodiment, is the same shape as the hole (e.g., circular) and is slightly larger than the ornament and aperture.

For example, the frame has a circular hole 8 on one end of the frame 5 where the diameter is approximately the same size as the ornament 4. The metal, circular backing 7 is slightly larger than the ornament and aperture through which the ornament protrudes, is slightly smaller than the hole end of the frame, and is fixed to the back of the ornament. In this way, once the ornament is inserted into the hole from the back with the spring tension clip 6 pressing against the backing, the ornament is secured snugly in the hole.

Typically, the backing portion is composed of lightweight metal. Often, but not always, it is composed of the same type as that of the frame for a more consistent look. However, the materials used to create the backing portion are inconsequential so long as it prevents the ornament from falling through the hole in the frame.

The backing portion can be affixed to the back of the ornament in a variety of ways. In a preferred embodiment the backing plate is glued to the ornament. However, soldering the plate to the ornament, using magnetic elements, or other means commonly known in the art are acceptable so long as they do not interfere with the positioning, decorative function, or structural security of the ornament.

In another embodiment not shown here, there is no separate backing portion. Instead the ornament is crafted as a single piece with one or more flanges, or a single lip on or around its circumference or edges that prevents the ornament from passing through the hole. In this embodiment, the flange or flanges stop the ornament from passing through the hole and are hidden from frontal view.

The present invention, as stated above, is not limited to a pendant design but can also be incorporated into other jewelry pieces. FIGS. 4 through 7 illustrate two other possible embodiments of the present invention.

Figure 4:
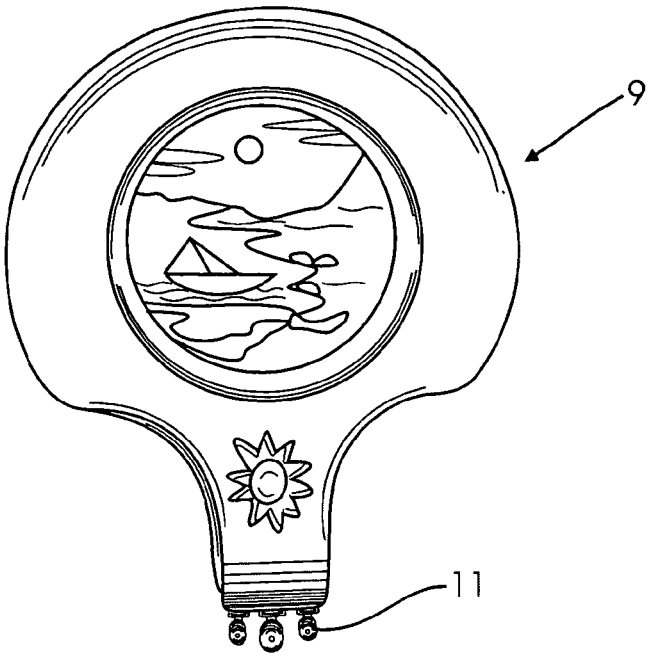
FIG. 4 is a front view of a pin embodiment of the present invention.
Figure 5:
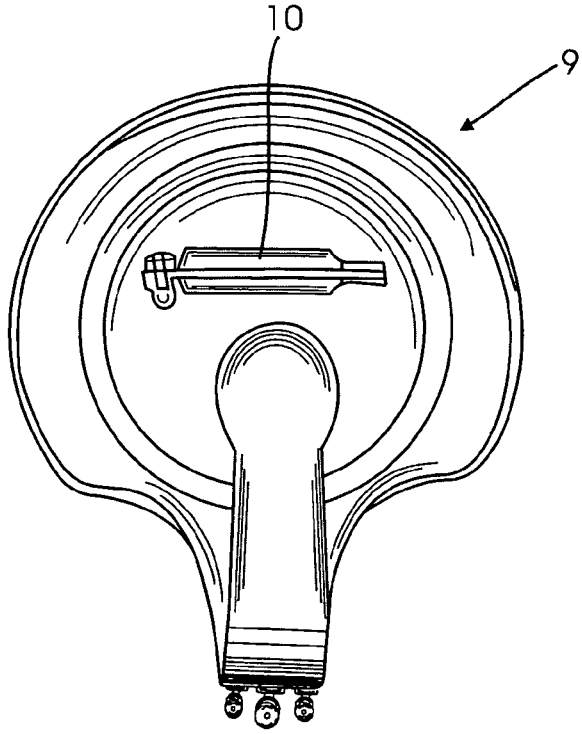

FIGS. 4 and 5 illustrate the present invention as incorporated on a pin 9. Here, a pin fastener 10 is affixed to the back of the backing portion. FIG. 4 shows the front of the pin with added decorative elements 11 and FIG. 5 shows the back of the pin.

Figure 6:
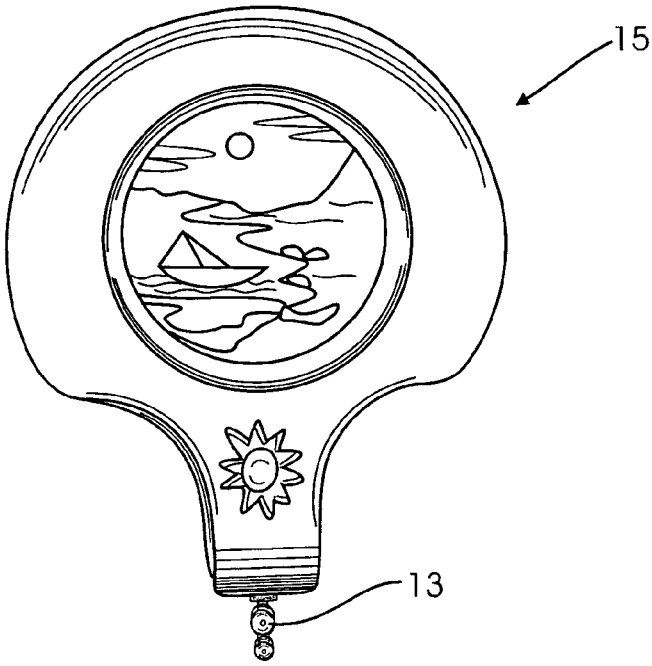
FIG. 6 is a front view of an earring embodiment of the present invention.
Figure 7:
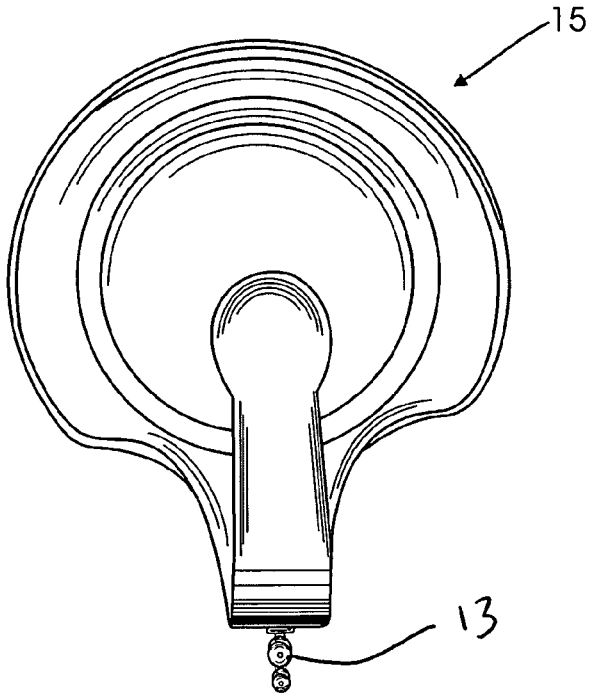
FIG. 7 is a rear view of an earring embodiment of the present invention.

FIGS. 6 and 7 illustrate how the present invention can be incorporated into an earring 15 with an earring post 13. Here, FIG. 6 shows the front of the earring and FIG. 7 shows the back.

Typically, the clip of the pin, earrings, and bracelet arrangements will vary in a size that best meets their aesthetic requirements. FIG. 8 shows how these requirements may change depending on the shape desired. A look at the pendants, earrings, pins, and bracelets of FIG. 8 demonstrate a fraction of the shapes that can be cut to form an aesthetically pleasing jewelry item.

Other embodiments for incorporating the present invention are plentiful. Tie tacks, cuff-links, brooches or many other types of jewelry known by whatever names are capable of assuming the design and method of the present invention.

Similar methods can be employed for using the present invention in a bracelet or necklace design. A preferred embodiment shown in FIG. 1 includes a simple method of passing a cord or chain 2 through the fold 3 of the folded frame so that the pendant is held by gravity while worn. However, other methods not shown here could include cutting a hole in the frame through which a pendant bail or jump ring is passed. The cord or chain is then threaded through the bail or jump ring. Further, other known mechanisms for securing the strand to the frame could include soldering, gluing, or otherwise affixing commonly known attachment findings to the frame.

CONCLUSION, RAMIFICATIONS, AND SCOPE

While the above description contains much specificity, these should not be construed as limitations on the scope of the invention, but as exemplifications of the presently preferred embodiments thereof. Many other ramifications and variations are possible within the teachings of this specification.

Thus the scope of the invention should be determined by the appended claims and their legal equivalents, and not solely by the examples given.

The invention claimed is:

1. A jewelry device for displaying decorative ornamentation comprising:

a spring tension member with a first and second ends;

said first and second ends are oppositely positioned from each other;

said first end is enlarged with an aperture and further comprises a front and a back;

said decorative ornamentation adapted to protrude through the aperture from the back through the front end and further comprising a backing portion that abuts the first end;

said decorative ornamentation and backing portion are removably secured through spring tension between the enlarged first end and the second end;

said spring tension member further comprising either an earring post, pin, necklace, or a bracelet coupled to the spring tension member for removably securing to a person; and said spring tension member comprises decorative means.

2. A method for creating a jewelry device for interchangeable decorative ornamentation comprising:

creating a spring tension member into a desired shape with first and second ends;

creating said spring tension member such that it forms a clip capable of removably securing an ornament having a backing portion, between the first and second ends; and said ornament further comprising either a necklace, bracelet, pin, or earring post for securing to a person.

* * * * *